US010501294B1

(12) United States Patent
Solberg

(10) Patent No.: US 10,501,294 B1
(45) Date of Patent: Dec. 10, 2019

(54) REMOTE CONTROLLED PULLEY FOR FISHING ACCESSORIES

(71) Applicant: Kory Solberg, Gonvick, MN (US)

(72) Inventor: Kory Solberg, Gonvick, MN (US)

( * ) Notice: Subject to any disclaimer, the term of this patent is extended or adjusted under 35 U.S.C. 154(b) by 0 days.

(21) Appl. No.: 15/729,266

(22) Filed: Oct. 10, 2017

Related U.S. Application Data

(60) Provisional application No. 62/408,244, filed on Oct. 14, 2016.

(51) Int. Cl.
*B66D 3/20* (2006.01)
*B66D 3/00* (2006.01)
*B66D 3/26* (2006.01)

(52) U.S. Cl.
CPC ..... *B66D 3/20* (2013.01); *B66D 3/26* (2013.01); *B66D 3/00* (2013.01)

(58) Field of Classification Search
CPC ... B66D 3/20; B66D 3/26; B66D 1/12; B66D 1/36; B66D 1/46; B66D 1/505
See application file for complete search history.

(56) References Cited

U.S. PATENT DOCUMENTS 3,687,418 A * 8/1972 Halvorsen ..... A01K 73/06 254/264
4,576,542 A * 3/1986 Brasell ..... B66D 3/00 294/67.1
4,582,299 A 4/1986 Royle
4,627,374 A 12/1986 Wright
4,753,400 A 6/1988 Reuter et al.
5,581,930 A * 12/1996 Langer ..... A01K 79/02 43/17
6,923,452 B1 8/2005 Zachmeier et al.
7,543,798 B2 6/2009 Cunningham
7,913,978 B1 * 3/2011 Trihey ..... B66D 3/006 254/323
8,006,958 B2 * 8/2011 Starks ..... B66D 3/20 254/323
9,422,139 B1 8/2016 Bialkowski et al.
2005/0036031 A1 * 2/2005 Weber ..... A01K 91/08 348/81
2005/0253125 A1 * 11/2005 Drarvik ..... B66D 1/12 254/347
2006/0097236 A1 * 5/2006 Copeman ..... B66D 1/08 254/361

(Continued)

FOREIGN PATENT DOCUMENTS

WO 2004095918 A1 11/2004

*Primary Examiner* — Michael E Gallion
(74) *Attorney, Agent, or Firm* — Westman, Champlin & Koehler, P.A.

(57) ABSTRACT

A remote controlled pulley device for moving a cord of an underwater accessory comprising a motor; a drive pulley and a follower pulley spaced a distance from the drive pulley for frictionally engaging cord there between. A receiver is in communication the motor, where signals from the receiver cause the motor to turn on and off, which in turn causes the drive pulley to move or rotate in a forward or reverse direction, thus moving the cord frictionally engaged therewith. A battery is provided and configured to power the motor. A battery powered hand-held remote control device is provided and the receiver is configured to receive commands from the hand-held remote control to rotate the drive pulley and thus move the cord.

14 Claims, 2 Drawing Sheets

(56) References Cited

U.S. PATENT DOCUMENTS

2007/0045601 A1* 3/2007 Rhee ..... A01K 79/02
254/383
2007/0242134 A1* 10/2007 Zernov ..... H04N 5/2252
348/81
2013/0107031 A1* 5/2013 Atkinson ..... H04N 1/00347
348/81
2014/0348593 A1* 11/2014 Kawahara ..... B66D 1/60
405/224
2015/0329335 A1* 11/2015 Azzarelli ..... B66D 3/006
254/323
2016/0178993 A1* 6/2016 Bianciardi ..... A01K 91/06
348/81

* cited by examiner

REMOTE CONTROLLED PULLEY FOR FISHING ACCESSORIES

CROSS-REFERENCE TO RELATED APPLICATIONS

This application claims priority to and the benefit of U.S. provisional patent application Ser. No. 62/408,244, filed on Oct. 14, 2016, the contents of which are incorporated herein in its entirety.

BACKGROUND

This disclosure relates to a remoted controlled pulley device. More specifically, this disclosure relates to a remote controlled pulley device for moving a cord attached to an underwater accessory for fishing.

Underwater accessories are aids used in activities such as fishing and more specifically, ice fishing or in other situations where visibility is low. However, where the accessories are lowered into the water, the attached cord(s) may hinder a fisherman's ability to catch fish. The accessory and the cord may become tangled or otherwise interfere with the fishing line and/or hook.

Retraction or retrieval of the accessory from the water is generally slow and requires manually pulling the accessory out of the water. This action can be difficult for a single person that is also typically trying to land a caught fish.

SUMMARY

An aspect of the present disclosure relates to a remote controlled pulley device for a cord of an underwater accessory. The device comprises a motor; a drive pulley operably connected to the motor and a follower pulley spaced from the drive pulley a selected distance. The drive pulley and the follower pulley are configured to frictionally engage the cord. A receiver is in communication with the motor, where signals from the receiver cause the motor to turn on and off, which in turn causes the drive pulley to rotate at least the drive pulley in a clockwise or counterclockwise direction. A battery powered hand-held remote control device is configured to transmit commands to the receiver and thus the receiver is configured to receive commands from the hand-held remote control.

The follower pulley has a position that is adjustable. The distance between the drive pulley and the follower pulley forms a cord channel that is selectively adjustable for frictionally engaging the cord there between.

The device also comprises a mounting plate configured for removable attachment to an above water structure. The mounting plate supports one or more of the drive pulley, follower pulley, the receiver or the battery thereon. Further, the underwater accessory comprises an underwater camera, a sonar unit, a lighting device, a magnet, or a retrieval device, or combinations thereof.

Another aspect of the present disclosure relates to a method of remotely positioning a corded device underwater, or retrieving the corded device from underwater, where the device is an underwater accessory comprising an underwater camera, a sonar unit, a lighting device, a magnet or a combination thereof. The method comprises providing a motorized cord movement system. The cord movement system has a drive pulley and a follower pulley spaced from the drive pulley a selected distance. The drive pulley and the follower pulley are configured to frictionally engage the cord there between. The method further comprises positioning a portion of the cord between the drive pulley and follower pulley and sending a command from a battery powered hand-held remote control device to a receiver and causing the motorized drive pulley to rotate in a clockwise or counterclockwise direction. This engages the cord to move the corded device to an underwater position or retrieve the corded device from underwater.

Yet another aspect of the present disclosure relates to an automatic cord moving system. The system has a mounting plate configured for attachment to an above water structure. The mounting plate supports a motor, a drive pulley operably connected to the motor, a power source, and a receiver thereon. A follower pulley is spaced apart from the drive pulley a selected distance to provide a cord channel for frictionally engaging a length of cord between the drive pulley and follower pulley. The receiver is in communication with the motor, such that signals from the receiver cause the motor to turn on and off, which in turn causes the drive pulley to rotate in a clockwise or counterclockwise direction thus moving the cord engaged between the drive pulley and the follower pulley in a forward or reverse direction.

DETAILED DESCRIPTION

A remotely operated pulley device is configured to engage a portion of a cord secured to an underwater accessory for selecting a position of the underwater accessory. The device allows for lowering the accessory into the water and/or retrieving the accessory from the water. The device can be attached to any above water unit and/or used with any underwater accessory requiring a cord. Examples of underwater accessories in which the device discussed herein can be used with include, but are not limited to, underwater fishing cameras, sonar equipment, lighting devices, and/or devices for retrieving items dropped below the water surface.

The device is configured to receive a command for moving a drive pulley of a pulley system and thus moving a length of the cord frictionally engaged between the drive pulley and a follower pulley of the pulley system, for the duration of the command. In one embodiment, the remote controlled device allows a user to initiate and/or continue retrieving or lowering the accessory from a distance. The device also allows the user to select the length of cord retrieved or lowered. Thus, the user can fully remove the accessory or drop the accessory attached to the cord as far as the cord length will allow; or move the cord a selected distance to position the accessory at a depth therebetween. While the present disclosure is directed to an underwater accessory, such as an underwater fishing camera, the present disclosure is not limited to underwater accessories or fishing accessories.

Figure 1:
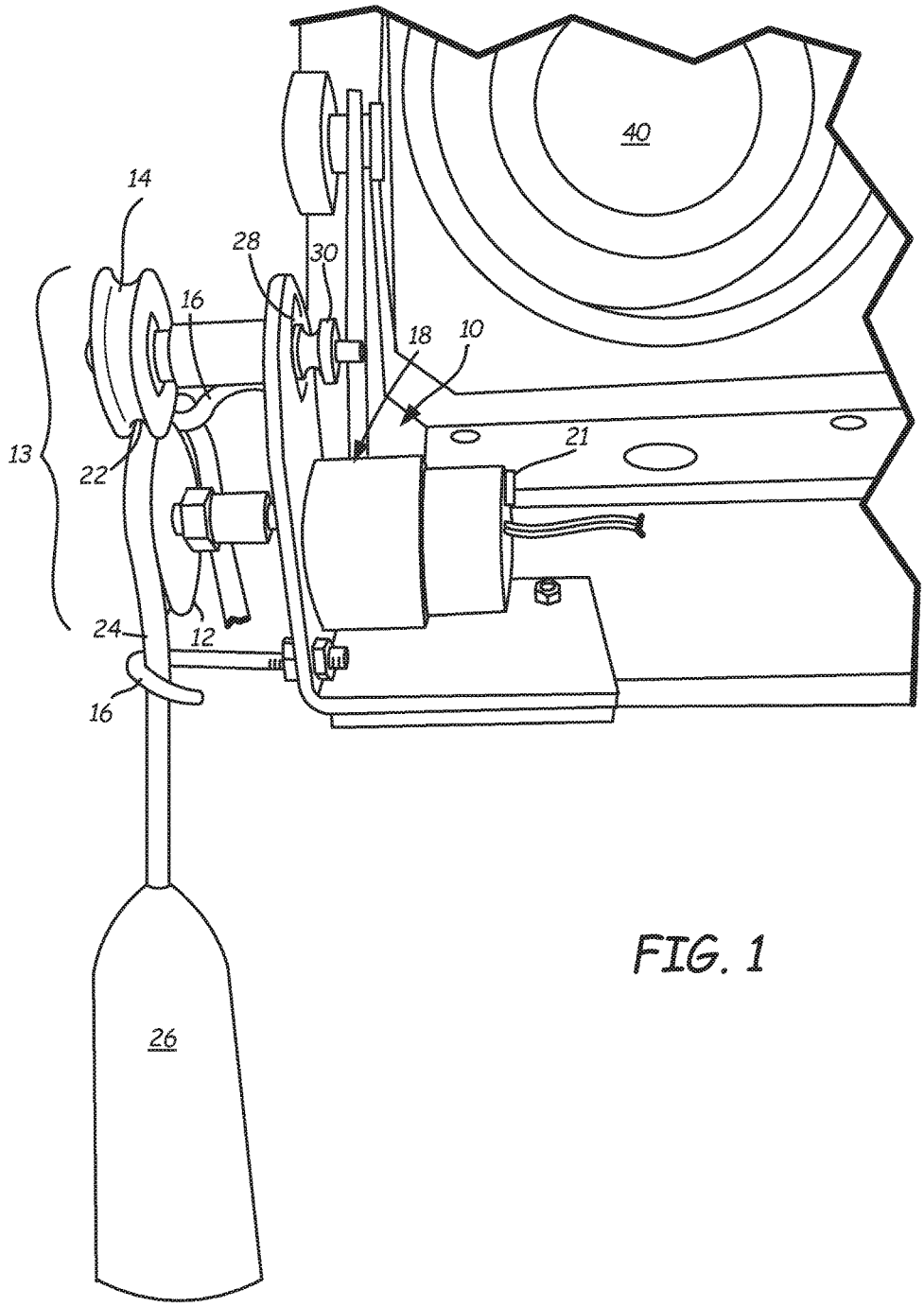
FIG. 1 is a front view of a remote controlled pulley device secured to an underwater accessory.
Figure 2:
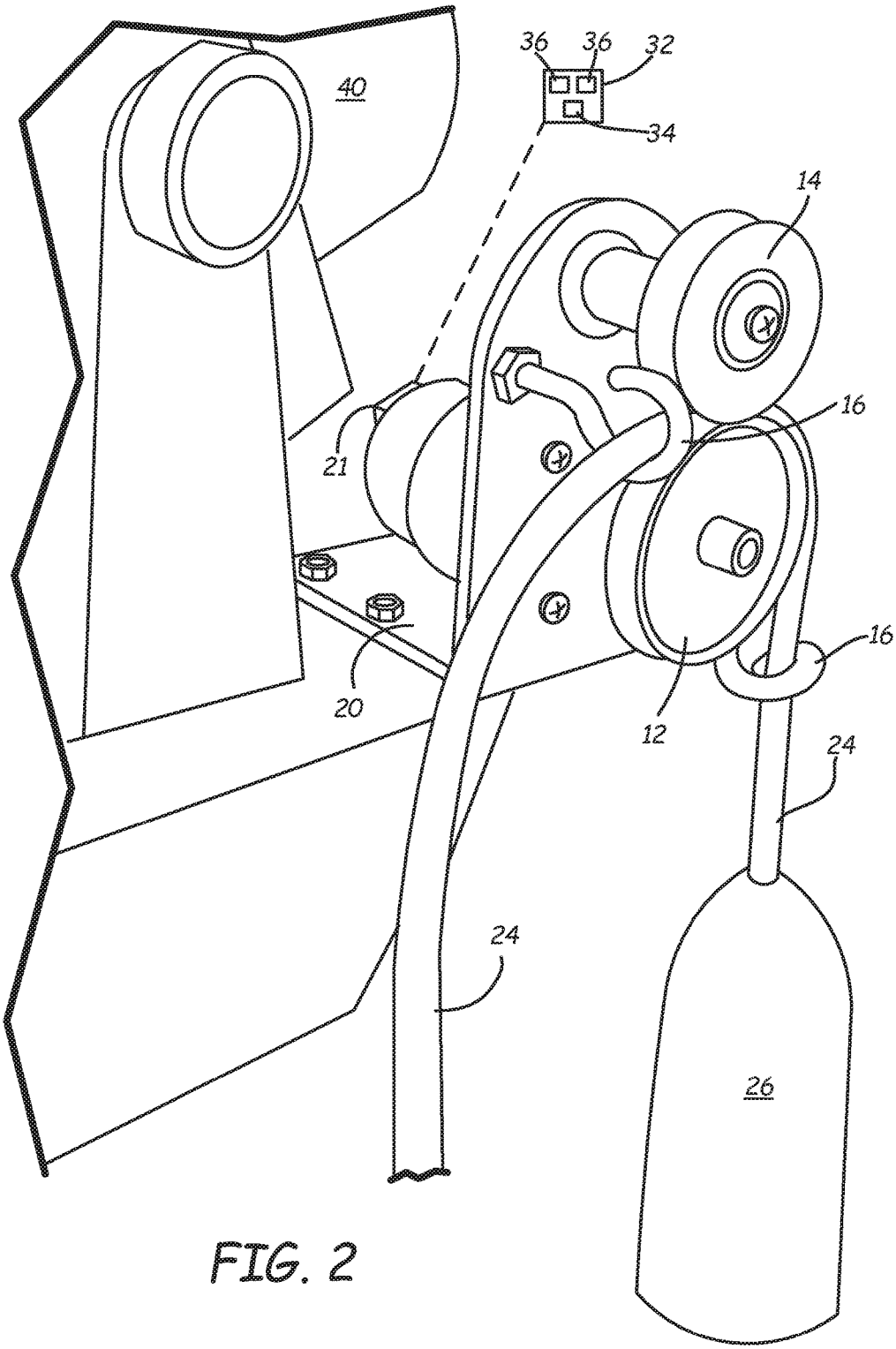
FIG. 2 is a rear perspective view of the remote controlled pulley device secured to the underwater accessory.

A remote controlled pulley device is illustrated generally at 10 in FIGS. 1-2. Referring to FIG. 1, the device 10 has a mounting or support plate 20 for mounting the device to an above water structure, such as a control unit or power unit for the underwater or fishing accessory, or otherwise mounting the device to a support or housing located above the water.

The mounting plate 20 supports a pulley system 13 rotatably secured thereto and at least one cord guide 16 also supported by or on the mounting plate 20. A motor 18 is operably connected to the pulley system 13 and secured to the mounting plate 20. A receiver 21 is in communication with the motor 18, such that signals from the receiver 21 cause the motor to turn on and/or off which in turn rotates drive pulley 12 and follower pulley 14 of the pulley system 13 in a clockwise or counterclockwise direction, which moves a length of a cord frictionally engaged between the drive pulley and the follower pulley.

The mounting plate 20 is constructed of plastic, aluminum, steel or similar materials. The mounting plate 20 illustrated in FIG. 1 is a metal "L" shaped bracket. The bracket is adapted with a plurality of apertures configured to receive fasteners for removably securing the device components to the mounting plate. Individual components may also be welded or otherwise operably secured to the mounting plate 20.

The device 10 is removably securable to an above water structure, for example, an underwater accessory unit or control system 40, such as the cord housing, electronics housing, or other unit for storing the device with which it is used. The mounting plate 20 has apertures for removably securing the plate to the above water structure 40. As noted previously, the underwater device may be a camera, a recorder, a light, a magnet, or comprise sonar equipment, combinations thereof, and all of which would be configured for underwater use.

The pulley system 13 is a dual pulley system that is mounted to a wall of the mounting plate 20. The pulley system 13 cooperates to push and/or pull a length of the cord 24 to let out and/or take up a selected length of the cord 24. In the embodiment illustrated, the pulley system 13 includes drive pulley 12 and follower pulley 14 which are secured on a same side of the mounting plate 20, and in a parallel orientation. The pulleys 12 and 14 are positioned substantially one on top of the other, with a space there between. This spaced defines a cord channel 24. The drive pulley 12 has a groove of a size sufficient to receive the cord 24. The follower pulley 14 need not be the same size (e.g. diameter) as the drive pulley 12, however the follower pulley should be of a size sufficient to provide a downward clamping effect on the cord 24 when the cord 24 is positioned within the channel 22.

The follower pulley 14 is rotatably secured to the plate 20 at an adjustable distance from the drive pulley 12 (e.g., adjustable height). A pulley mounting aperture 28 in the plate 20 is an elongated aperture 28. The aperture 28 is configured to receive a connecting axle of the follower pulley 14 at a selected point along a length of the aperture 28. This provides for an adjustable cord channel 24 as the distance between the drive pulley 12 and follower pulley 14 can be adjusted. The channel 24 can be adjusted based on size of the cord 22 so that the pulleys 12 and 14 sufficiently clamp the cord within the channel 22 for pushing or pulling the cord 24 continuously through the channel 22 with the cooperation of the follower pulley 14. A fastener mechanism 30, for example, a knurled nut, is then tightened against the opposing side of the plate 20 to secure the follower pulley 14 at the selected position.

The drive pulley 12 is operably connected to the motor 18. The motor 18 provides rotational movement to the drive pulley 12, which in turn rotates the follower pulley 14 in the same direction when the cord 24 is fed through and retained within the channel 22. In the example illustrated, the motor 18 is operably connected to the lower pulley 12.

The motor 18 may be an electric motor 20 that is powered by a battery 23. Alternatively, the motor 18 can be connected to a power source of the fishing accessory with which it used. A small electric motor, configured for at least about 60 RPM or up to about 100 RPM may be used. Electric motors of different sizes may be used depending on the dimensions and weight of the selected cord and/or the corresponding accessory.

The electric motor 18 is secured to an opposite side of the mounting plate 20 from the pulleys 12 and 14. The motor 18 is connected to an axle that extends through the plate 20 and into connection with the drive pulley 12 in order to transfer rotational movement to the drive pulley 12 when the motor is on. The motor 18 of the device 10 can be remotely activated such that the device 10 is remotely controlled for pulling the length of the cord inwardly or upwardly and out of the water when selected. The device 10 can also be remotely activated to push the cord downwardly or outwardly for positioning the device 26 attached to the cord 24 underwater. As illustrated in the figures, a fishing accessory 26 is operably secured at a terminal end of the cord 24.

Two cord guides 16 are mounted on the plate 20 and positioned to extend from a connection with the plate 20 on the same side as the pulley system 13. The cord guides 16 are constructed of aluminum or steel, or a similar material and are hooks having a threaded end portion inserted through an aperture in the plate and secured thereto with two opposing nuts. Alternatively, the cord guides 16 may be welded to the plate 20. The two cord guides 16 are positioned to guide the cord 24 between the drive and follower pulleys 12 and 14. A stop 38 is also supported by the support plate 20 to provide an extended length of cord 24 and prevent the cord 24 and device 26 from dropping too far underwater.

The device 10 includes a receiver 21 in communication the motor 18, where signals from the receiver 21 cause the motor 18 to turn on and move the drive pulley 12 in a forward or reverse direction, which in turn causes the cord to move in a forward or reverse direction. The receiver 21 is configured to receive commands from a hand-held remote control 32 that is powered by a dry cell battery 34. The receiver 21 may be positioned on or near the support plate 20.

As illustrated in FIG. 2, the receiver 21 is mounted on the support plate 20. The remote control 32 includes at least one push-button mechanism 36 for initiating and sending signals to the receiver 21. Pressing and/or holding the push-button 36 provides signals to the receiver 21, which are then sent to the motor 18. Holding down the corresponding push-button 36 provides a signal from the remote control 32 to the receiver 21 for continuous power to the motor and thus movement of the cord in the respective direction while the push-button 32 is depressed. The remote control 32 provides the user with the ability to select the time, duration and direction of the cord 24 movement by pressing and/or holding down the push-button 36.

As noted previously, the device 10 is mountable to a unit 40 or other structure positioned outside of the water and/or which dispenses the cord 24 therefrom. The unit or other structure is configured for positioning outside of the water, for example, resting on the surface of ice when ice fishing or sitting in a boat or on a dock when fishing.

In the illustrated embodiment, the device 10 is removably secured to an underwater fishing camera unit 40. The remote control 32 allows the user to quickly and remotely take up a length of the cord 24, let out a length of the cord 24 and/or position the underwater camera 26 at a selected depth underwater.

Although the present disclosure has been described with reference to preferred embodiments, workers skilled in the art will recognize that changes may be made in form and detail without departing from the spirit and scope of the disclosure.

The invention claimed is:

1. A remote controlled pulley device for a cord of an underwater accessory comprising:

a motor;

a drive pulley operably connected to the motor;

a follower pulley spaced from the drive pulley a selected distance, the drive pulley and the follower pulley configured to frictionally engage and move the cord;

first and second cord guides positioned proximate the drive pulley and on opposing sides of the follower pulley, wherein the first and second cord guides are configured to pass a length of the cord there through and direct the cord toward or away from the drive pulley along a path between the first and second cord guides;

a receiver in communication with the motor, where signals from the receiver cause the motor to turn on and off, which in turn causes the drive pulley to rotate at least the drive pulley in a clockwise or counterclockwise direction; and a battery powered hand-held remote control device and wherein the receiver is configured to receive commands from the hand-held remote control.

2. The device of claim 1 wherein the follower pulley is adjustable such that the distance between the drive pulley and the follower pulley forms a cord channel that is selectively adjustable for frictionally engaging the cord there between.

3. The device of claim 1, and further comprising a mounting plate configured for removable attachment to an above water structure wherein the mounting plate supports one or more of the drive pulley, follower pulley, receiver or battery thereon.

4. The device of claim 1, wherein the underwater accessory comprises an underwater camera, a sonar unit, a lighting device, a magnet, or a retrieval device, or combinations thereof.

5. The device of claim 1, wherein the first and second cord guides each comprises an interrupted loop configured to pass the cord into an interior space of the loop.

6. The device of claim 3, wherein the mounting plate comprises a plurality of surfaces and wherein the drive pulley is supported by a first surface of the mounting plate and the motor is supported by a second, opposing surface of the mounting plate.

7. A method of remotely positioning a corded device underwater or retrieving the corded device from underwater, where the device is an underwater accessory comprising an underwater camera, a sonar unit, a lighting device, a magnet or a combination thereof, the method comprising:

providing a motorized cord movement system comprising a drive pulley and a follower pulley spaced from the drive pulley a selected distance wherein the drive pulley and the follower pulley are configured to frictionally engage the cord there between;

positioning a first portion of the cord between the drive pulley and follower pulley;

positioning a second portion of the cord within a first cord guide located proximate the drive pulley and on a first side of the follower pulley;

positioning a third portion of the cord within a second cord guide located proximate the drive pulley and on a second side of the follower pulley, wherein the first cord guide and the second cord guide define a path for the cord around the drive pulley;

sending a command from a battery powered hand-held remote control device to a receiver and causing the motorized drive pulley to rotate in a clockwise or counterclockwise direction and engage the cord to move the corded device to an underwater position or retrieve the corded device from underwater while moving the cord along the path.

8. The method of claim 7 and further comprising:

utilizing the remote control to select a time, duration and direction of the movement of the drive pulley to move the cord along the path so as to move the corded device to a selected position.

9. The method of claim 8, and further comprising securing a mounting plate supporting the drive pulley and the follower pulley to an above water structure.

10. An automatic cord moving system comprising:

a mounting plate configured for attachment to an above water structure, the mounting plate supporting a motor, a drive pulley operably connected to the motor, a power source, and a receiver thereon; and a follower pulley spaced apart from the drive pulley a selected distance to provide a cord channel for frictionally engaging a length of cord between the drive pulley and follower pulley;

first and second cord guides positioned proximate the drive pulley and on opposing sides of the follower pulley, wherein the first and second cord guides are configured to pass a length of the cord there through and direct the cord toward or away from the drive pulley along a path between the first and second cord guides; and wherein the receiver is in communication with the motor, such that signals from the receiver cause the motor to turn on and off, which in turn causes the drive pulley to rotate in a clockwise or counterclockwise direction thus moving the cord engaged between the drive pulley and the follower pulley in a forward or reverse direction along the path.

11. The system of claim 10, wherein a terminal end of the cord is connected to an underwater accessory that is an underwater camera, sonar unit, lighting device, magnet or other retrieval device or a combination thereof.

12. The system of claim 10, wherein the power source is a battery retained on or proximate the mounting plate and configured to power the motor.

13. The system of claim 10, and further comprising a battery powered hand-held remote control device wherein the receiver is configured to receive commands from the hand-held remote control.

14. The system of claim 10 wherein the housing is the above water structure comprises a housing associated with the underwater accessory and an initial end of the cord is secured to the housing.

* * * * *